US007318421B2

(12) United States Patent
Fukasawa

(10) Patent No.: US 7,318,421 B2
(45) Date of Patent: Jan. 15, 2008

(54) STARTUP CONTROLLER FOR IN-CYLINDER INJECTION INTERNAL COMBUSTION ENGINE

(75) Inventor: Osamu Fukasawa, Nagoya (JP)

(73) Assignee: Denso Corporation, Kariya, Aichi-pref. (JP)

( * ) Notice: Subject to any disclaimer, the term of this patent is extended or adjusted under 35 U.S.C. 154(b) by 92 days.

(21) Appl. No.: 11/397,644

(22) Filed: Apr. 5, 2006

(65) Prior Publication Data

US 2006/0225695 A1 Oct. 12, 2006

(30) Foreign Application Priority Data

Apr. 8, 2005 (JP) ..... 2005-111529

(51) Int. Cl.
*F02D 41/06* (2006.01)
*F02D 41/40* (2006.01)
*F02M 7/00* (2006.01)

(52) U.S. Cl. ..... 123/491; 123/435; 123/456

(58) Field of Classification Search ..... 123/491, 123/494, 435, 357, 456, 481, 198 D, 198 DB; 701/103–105, 112–113, 115
See application file for complete search history.

(56) References Cited

U.S. PATENT DOCUMENTS 6,085,727 A * 7/2000 Nakano ..... 123/447
6,694,953 B2 * 2/2004 Barnes et al. ..... 123/500

FOREIGN PATENT DOCUMENTS

JP 11-270385 10/1999
JP 2000-257478 * 9/2000

* cited by examiner

*Primary Examiner*—Hai Huynh
(74) *Attorney, Agent, or Firm*—Nixon & Vanderhye P.C.

(57) ABSTRACT

A startup controller calculates a fuel pressure difference across a discharge stroke of a high-pressure pump at an end of an initial discharge after cranking is started. At the injection setting, the startup controller estimates a fuel pressure increment from an injection setting to an injection start based on the fuel pressure difference. The startup controller adds the fuel pressure increment to a fuel pressure sensed at the injection setting to estimate a fuel pressure at the injection start. The startup controller determines whether to perform or to prohibit the injection based on whether the estimated fuel pressure at the injection start is equal to or higher than an injection permission fuel pressure.

14 Claims, 10 Drawing Sheets

STARTUP CONTROLLER FOR IN-CYLINDER INJECTION INTERNAL COMBUSTION ENGINE

CROSS REFERENCE TO RELATED APPLICATION

This application is based on and incorporates herein by reference Japanese Patent Application No. 2005-111529 filed on Apr. 8, 2005.

BACKGROUND OF THE INVENTION

1. Field of the Invention

The present invention relates to a startup controller for an in-cylinder injection internal combustion engine having a function of promptly increasing fuel pressure at a startup.

2. Description of Related Art

An in-cylinder injection engine, which injects fuel directly into a cylinder, takes a short time from injection to combustion compared to an intake port injection engine, which injects fuel into an intake port. The in-cylinder injection engine does not have enough time to atomize the injected fuel. Therefore, the in-cylinder injection engine has to elevate injection pressure to atomize the injected fuel. The in-cylinder injection engine is so constructed that fuel pumped up from a fuel tank by a low-pressure pump is pressurized and pressure-fed to a fuel injection valve by a high-pressure pump driven by a camshaft of the engine.

During stoppage of the engine, the high-pressure pump and low-pressure pump are also stopped and therefore fuel pressure in a fuel pipe decreases with time. Therefore, a prolonged engine stoppage causes the fuel pressure to be decreased to substantially 0 MPa. At startup, it takes a certain time for the fuel pressure to increase to a high fuel-pressure range suitable for the startup. Accordingly, the fuel is injected at a low fuel pressure at the startup, insufficiently atomizing the injected fuel. In this case, a combustion quality can be degraded or in-cylinder wet can increase, resulting in worsened startup properties and deteriorated exhaust emissions at the startup.

As a countermeasure against such problems, startup control for an in-cylinder injection engine described in JP-A-H11-270385 is arranged to stop injection for a predetermined period in an initial stage of the startup and to increase fuel pressure to a high fuel-pressure range suitable for the startup during the period of injection stoppage with the use of a high-pressure pump. Then, the control starts the injection.

With this startup control for the in-cylinder injection engine, however, the fuel injection is stopped at the startup until the fuel pressure is increased by the high-pressure pump to a high fuel-pressure range suitable for the startup. This causes problems of a prolonged startup time and an increased amount of emissions of in-cylinder residual gas including unburned hydrocarbon (HC).

The fuel-pressure increasing time at the startup can be shorted by increasing the size of the high-pressure pump or decreasing the volume of a high-pressure fuel pipe or delivery pipe. However, an increased high-pressure pump size brings about problems such as worsening of mountability into a vehicle, deterioration of fuel pressure controllability in a low-discharge range and an increase in fuel pressure pulsation.

SUMMARY OF THE INVENTION

It is an object of the present invention to provide a startup controller for an in-cylinder injection internal combustion engine capable of shortening a startup time without taking measures of increasing the size of a high-pressure pump or decreasing the volume of a high-pressure fuel pipe or delivery pipe, thereby meeting requirements such as improved startup properties and reduced emissions at startup.

According to an aspect of the present invention, a startup controller for an in-cylinder injection internal combustion engine has an injection setting device, an injection controlling device, a fuel pressure sensing device, and a startup controlling device. The injection setting device makes an injection setting for setting injection start timing and an injection duration prior to a start of injection. The injection controlling device drives a fuel injection valve to perform the injection at the injection start timing for the injection duration set by the injection setting device. The fuel pressure sensing device senses a pressure of the fuel to be supplied to the fuel injection valve. When the injection setting is made at a startup of the engine, the startup controlling device estimates a fuel pressure at a subsequent injection start based on the fuel pressure sensed by the fuel pressure sensing device and determines whether the injection by the injection controlling device should be performed or prohibited based on the estimated fuel pressure.

In injection control of the internal combustion engine, the injection setting is made a predetermined time (predetermined crank angle) before actual injection start timing to prepare for driving of the fuel injection valve. Therefore, whether or not the injection should be performed can be determined based on whether or not a sensed fuel pressure at the injection setting has increased to a high fuel-pressure range suitable for a startup. However, in some cases, even if an actual fuel pressure at the injection setting has not increased to a fuel pressure suitable for the startup, the fuel pressure can reach the fuel pressure suitable for the startup at a subsequent injection start because of fuel discharge from a high-pressure pump caused by cranking. In these cases, even if injection is performed, atomization of the injected fuel is ensured, thus not causing a problem such as increased emissions.

In view of this respect, even if the actual fuel pressure at the injection setting has not yet reached a predetermined fuel pressure, the controller according to an aspect of the present invention performs injection, provided that it is estimated that the fuel pressure at the injection start, which is estimated at the injection setting, will have increased to the fuel pressure suitable for the startup in the process of cranking of the internal combustion engine with a starter for the startup. Accordingly, a startup time can be shortened without taking the measures of increasing the size of the high-pressure pump or decreasing the volume of the high-pressure fuel pipe or delivery pipe, thereby meeting the requirements such as improved startup properties and reduced emissions at the startup.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF EXAMPLE EMBODIMENTS

Figure 1:
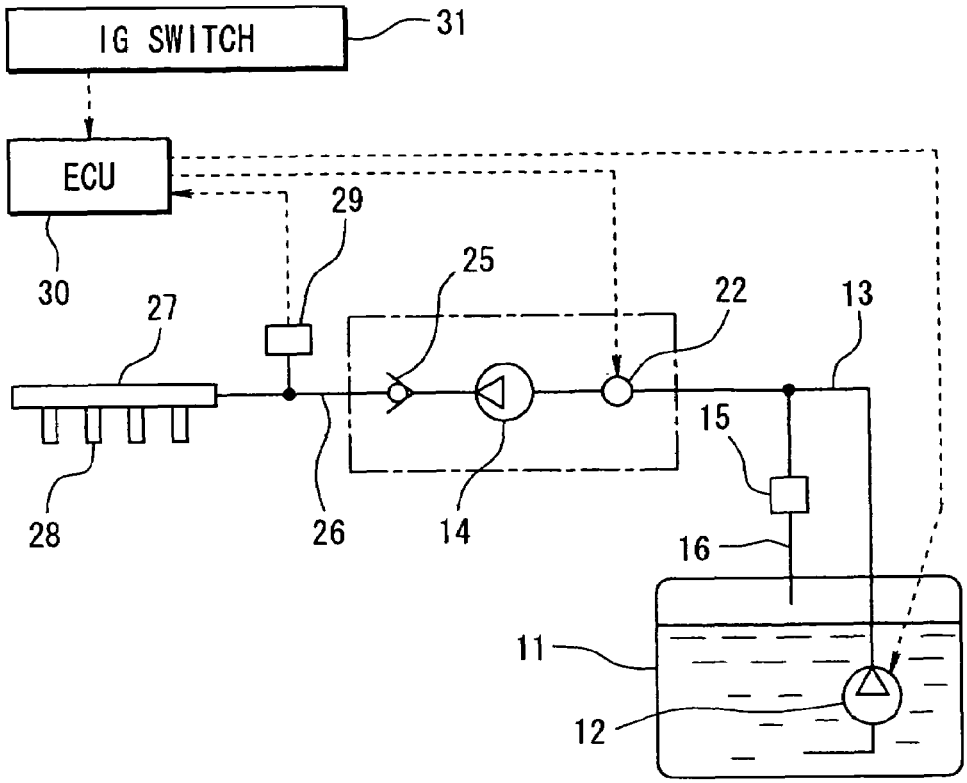
FIG. 1 is a schematic diagram showing a fuel injection system according to a first example embodiment of the present invention.

Referring to FIG. 1, a fuel supply system of an in-cylinder injection engine according to a first example embodiment is illustrated. A fuel tank 11 for reserving fuel is provided with a low-pressure pump 12 therein to pump up the fuel. The low-pressure pump 12 is driven by an electric motor (not shown) powered by a battery (not shown). The fuel discharged from the low-pressure pump 12 is supplied through a fuel pipe 13 to a high-pressure pump 14. A pressure regulator 15 is connected to the fuel pipe 13. The pressure regulator 15 regulates a discharge pressure of the low-pressure pump 12 (fuel supply pressure to the high-pressure pump 14) to a predetermined pressure. Surplus fuel generating an excess pressure is returned from the low-pressure pump 12 to the fuel tank 11 through a fuel return pipe 16.

Figure 2:
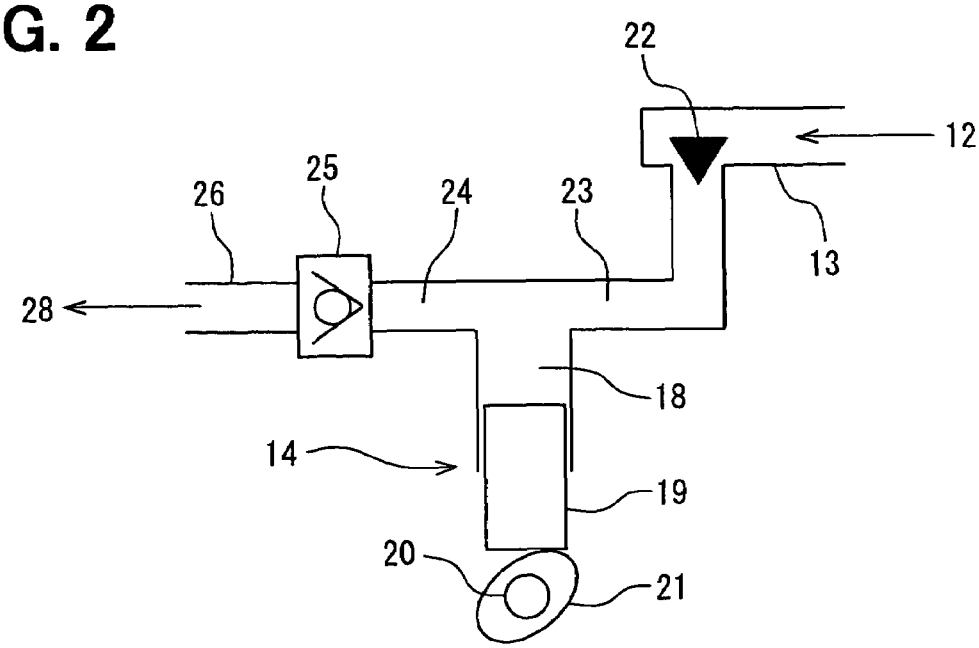
FIG. 2 is a schematic diagram showing a high-pressure pump according to the FIG. 1 embodiment.

As shown in FIG. 2, the high-pressure pump 14 is a piston pump that reciprocates a piston 19 in a cylindrical pump chamber 18 to suction and discharge the fuel. The piston 19 is driven by rotational movement of a cam 21 fitted on a camshaft 20 of the engine. A fuel pressure control valve 22 composed of an electromagnetic valve is provided on a suction port 23 side of the high-pressure pump 14. In a suction stroke of the high-pressure pump 14 (when the piston 19 descends), the fuel pressure control valve 22 is opened to allow the fuel to be suctioned into the pump chamber 18. In a discharge stroke (when the piston 19 ascends), a valve closing time of the fuel pressure control valve 22 is controlled to control fuel pressure (discharge pressure). When the fuel pressure is increased, the valve closing time of the fuel pressure control valve 22 is prolonged. When the fuel pressure is decreased, the valve closing time of the fuel pressure control valve 22 is shortened.

A check valve 25 for preventing a backflow of the discharged fuel is provided on a discharge port 24 side of the high-pressure pump 14. The fuel discharged from the high-pressure pump 14 is fed through a high-pressure fuel pipe 26 to a delivery pipe 27. The high-pressure fuel is distributed from the delivery pipe 27 to a fuel injection valve 28 installed for each cylinder in a cylinder head of the engine. A fuel pressure sensor 29 for sensing the fuel pressure is provided in the high-pressure fuel pipe 26. An output signal of the fuel pressure sensor 29 is input to an engine control unit (ECU) 30.

The ECU 30, which mainly comprises a microcomputer, reads output signals from various sensors for sensing engine operating conditions such as engine rotation speed, an intake pipe pressure (or intake air quantity), and coolant water temperature and calculates an injection duration (fuel injection quantity) and injection start timing. The ECU 30 then sets the injection start timing and the injection duration a predetermined time (predetermined crank angle) before an injection start and drives the fuel injection valve 28 at the injection start timing for the injection duration to perform fuel injection. The ECU 30 executes startup control routines stored in a built-in ROM (storage medium). Thus, at an injection setting at a startup, the ECU 30 estimates a fuel pressure at a subsequent injection start based on a fuel pressure sensed by the fuel pressure sensor 29 and determines whether to perform or to prohibit the injection based on the estimated fuel pressure.

Figure 3:
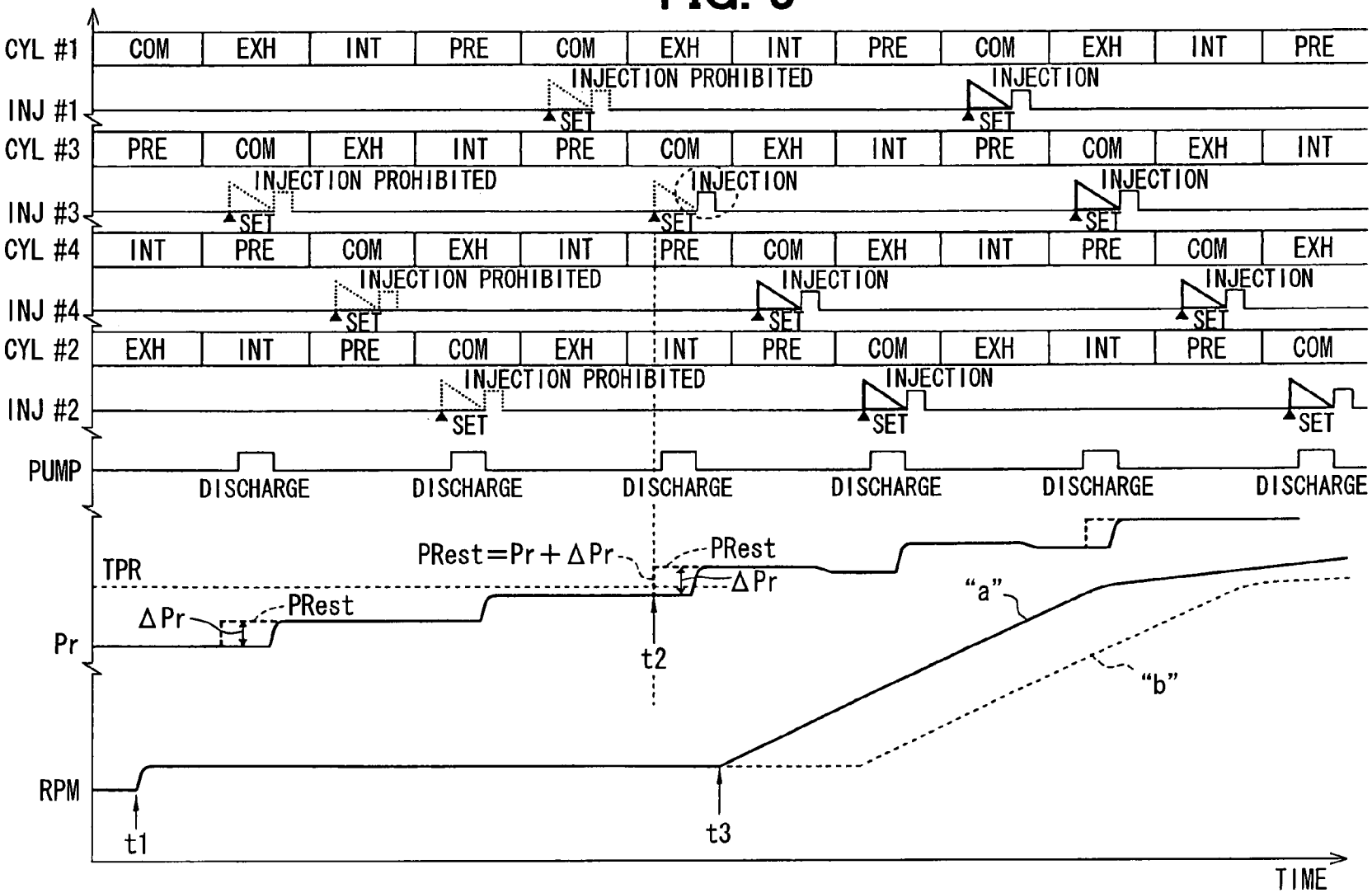
FIG. 3 is a time chart showing an example of startup control according to the FIG. 1 embodiment.

Now, a pressure rising startup control method according to this example embodiment will be described using a time chart of FIG. 3. FIG. 3 shows an example of startup control since cranking is started by operating an ignition switch (IG switch) 31 from an ON position to a START position such that a starter is energized until an engine startup is completed. In FIG. 3, signs CYL#1 to CYL#4 represent strokes of first to fourth cylinders of the engine. A sign COM represents a combustion stroke, a sign EXH is an exhaustion stroke, a sign INT is an intake stroke, and a sign PRE is a compression stroke of each cylinder. Signs INJ#1 to INJ#4 represent injection signals. A sign PUMP represents a high-pressure pump signal and a sign Pr is the sensed fuel pressure. A solid line "a" represents the engine rotation speed RPM corresponding to the present embodiment, and a slid line "b" represents the engine rotation speed RPM of a conventional technology.

In an initialization period (initialization processing period) immediately after the IG switch 31 is turned on, an output from the fuel pressure sensor 29 is read to measure an initial fuel pressure (base fuel pressure) P0 before discharging of the high-pressure pump 14. After the start of cranking (t1), an output from the fuel pressure sensor 29 is read at an end of an initial discharge stroke of the high-pressure pump 14 to measure a fuel pressure Pr after the initial discharge stroke of the high-pressure pump 14. A fuel pressure difference (Pr−P0) across the initial discharge stroke of the high-pressure pump 14 is calculated by subtracting the initial fuel pressure P0 from the fuel pressure Pr.

For each injection setting (indicated as "SET" in FIG. 3) of each cylinder, a fuel pressure increment ΔPr from the injection setting to the injection start is estimated based on the fuel pressure difference (Pr−P0) across the initial discharge stroke of the high-pressure pump 14 prior to the injection setting. For example, the fuel pressure difference (Pr−P0) across the initial discharge stroke of the high-pressure pump 14 is used as an estimate of the fuel pressure increment ΔPr from the injection setting to the injection start. The fuel pressure increment ΔPr is added to the fuel pressure Pr, which is sensed at the injection setting, to estimate a fuel pressure PRest (PRest=Pr+ΔPr) at the injection start. It is determined whether to perform or to prohibit the injection based on whether the estimated fuel pressure PRest at the injection start is "equal to or higher than" a predetermined fuel pressure (injection permission fuel pressure) TPR suitable for the startup. The injection is permitted at timing t2, and the first combustion occurs at timing t3 in FIG. 3.

In order to reduce a calculation load of the ECU 30, the fuel pressure increment ΔPr from the injection setting to the injection start may be a preset fixed value.

Figure 4:
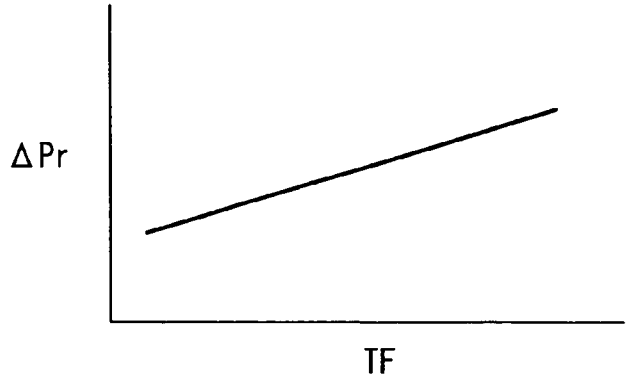
FIG. 4 is a diagram showing a map for calculating a fuel pressure increment according to the FIG. 1 embodiment.

As fuel temperature TF at the injection setting increases, the fuel pressure increment ΔPr tends to increase due to thermal expansion or the like of the fuel. Therefore, the fuel pressure increment ΔPr may be calculated in accordance with the fuel temperature TF at the injection setting based on a map or formula shown in FIG. 4. The ROM of the ECU 30 beforehand may store the map or formula for calculating the fuel pressure increment ΔPr that takes the fuel temperature TF as a parameter at the injection setting as shown in FIG. 4. The fuel temperature TF at the injection setting may be sensed or estimated by a sensor or the like.

Figure 5:
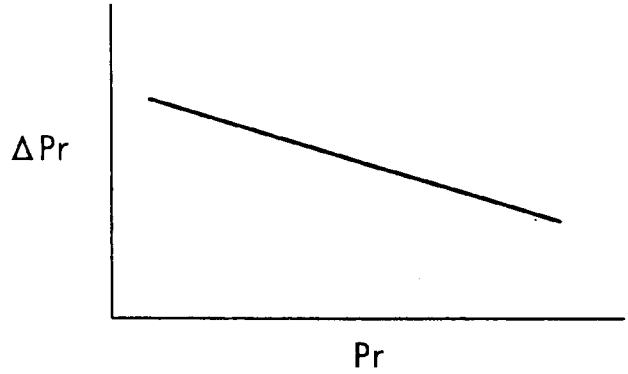
FIG. 5 is a diagram showing a map for calculating the fuel pressure increment according to the FIG. 1 embodiment.

As the fuel pressure Pr at the injection setting increases, the fuel pressure increment ΔPr tends to decrease. Therefore, the fuel pressure increment ΔPr may be calculated in accordance with the fuel pressure Pr sensed at the injection setting based on a map or formula of FIG. 5. The ROM of the ECU 30 may beforehand store the map or formula for calculating the fuel pressure increment ΔPr that takes the fuel pressure Pr at the injection setting as a parameter as shown in FIG. 5.

In order to improve estimation accuracy of the fuel pressure increment ΔPr, the fuel pressure increment ΔPr may be calculated in accordance with the fuel temperature TF and the fuel pressure Pr sensed at the injection setting based on a two-dimensional map or formula. The ROM of the ECU 30 may beforehand store the two-dimensional map or formula for calculating the fuel pressure increment ΔPr that takes the fuel temperature TF and the fuel pressure Pr at the injection setting as parameters.

Figure 6:
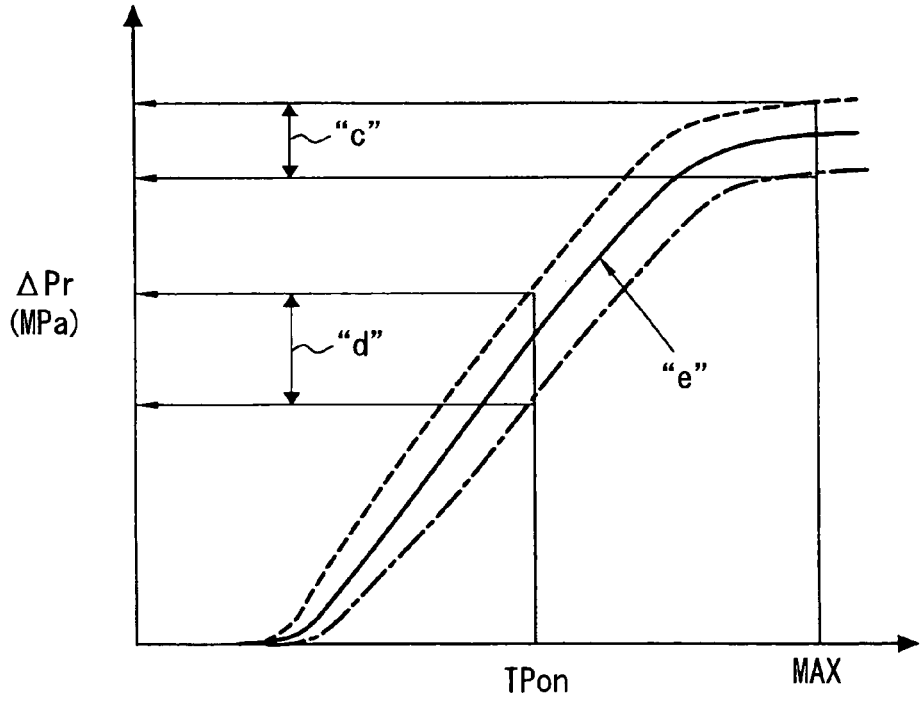
FIG. 6 is a diagram illustrating a range of a variation of discharge performance of the high-pressure pump according to the FIG. 1 embodiment.

As shown by ranges "c" and "d" in FIG. 6, discharge performance of the high-pressure pump 14 varies because of manufacturing tolerances, degradation with time, and the like. In FIG. 6, a sign TPon represents an energization duration of the high-pressure pump 14 and a solid line "e" represents a characteristic of a standard product. A sign "MAX" represents the maximum discharge. Therefore, the fuel pressure increment ΔPr varies depending on the variation in the discharge performance of the high-pressure pump 14 even if an energization time TPon of the high-pressure pump 14 (valve closing time of the fuel pressure control valve 22) is the same. Therefore, it is preferable to renew and store for each startup an actual measurement value of the fuel pressure increment ΔPr (value sensed by the fuel pressure sensor 29) from the injection setting to the injection start as a learned value in a rewritable nonvolatile memory such as a backup RAM of the ECU 30. It is preferable to use at an actual startup the learned value of the fuel pressure increment ΔPr stored in the nonvolatile memory to estimate the fuel pressure PRest at the injection start. In this case, in order to improve learning accuracy of the fuel pressure increment ΔPr, it is preferable to divide a memory area into multiple learning areas according to conditions such as fuel temperature and fuel pressure and to learn the fuel pressure increment ΔPr for each learning area. The fuel pressure increment ΔPr may be learned independently of the fuel temperature, fuel pressure, and the like.

Figure 7:
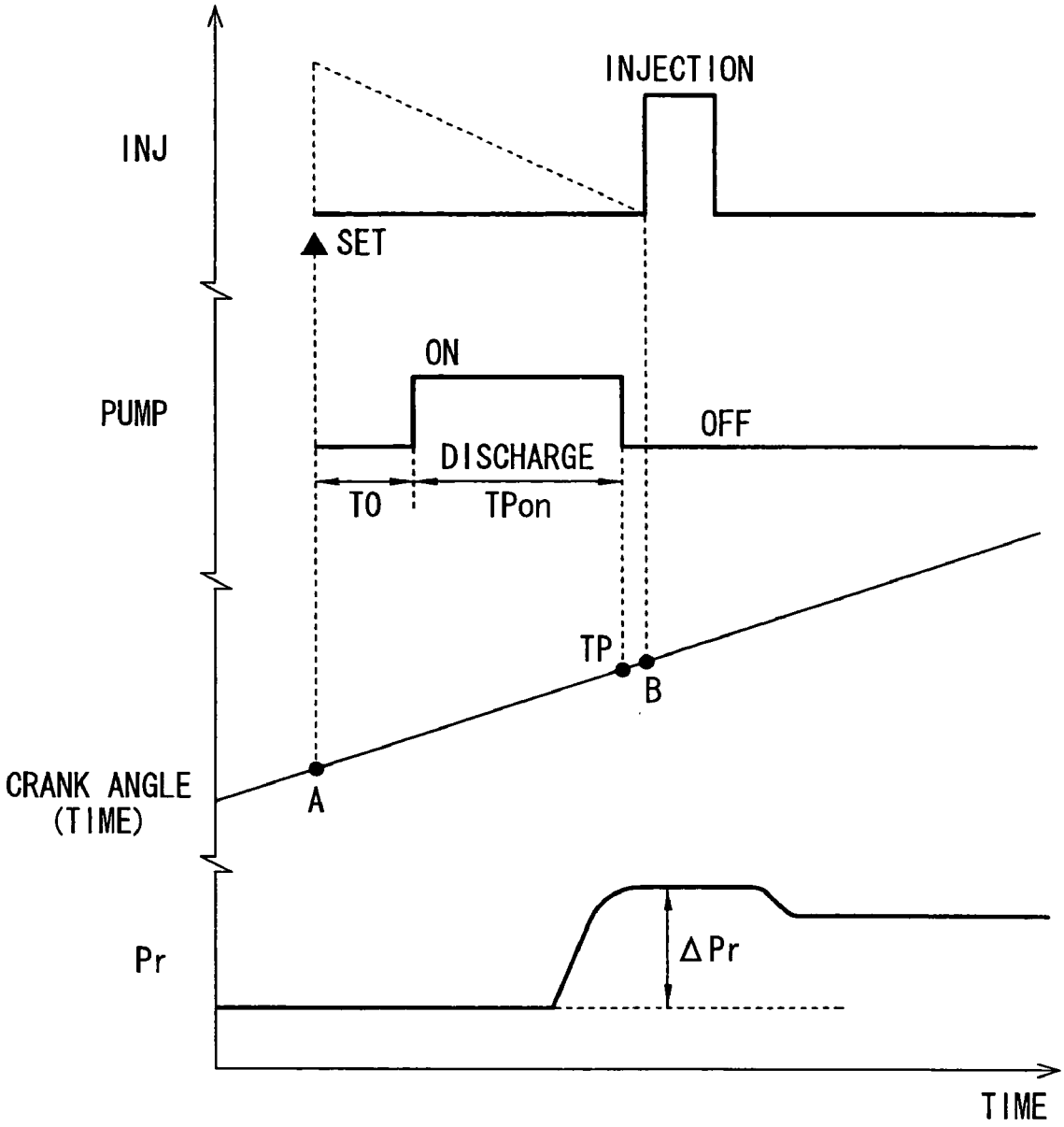
FIG. 7 is a time chart showing an example of control after an injection setting according to the FIG. 1 embodiment.

If no fuel is discharged from the high-pressure pump 14 during a period from the injection setting to the injection start, an estimate of the fuel pressure may not be necessarily calculated because the fuel pressure at the injection setting and the fuel pressure at the injection start are generally the same. As shown in FIG. 7, in this example embodiment, if the fuel is discharged from the high-pressure pump 14 (at a point TP) during the period from the injection setting (point A) to the injection start (point B), the fuel pressure PRest at the injection start (point B) is estimated by the above-mentioned method. Based on the estimated fuel pressure PRest, it is determined whether to perform the injection. If there is no fuel discharge from the high-pressure pump 14 during the period from the injection setting (point A) to the injection start (point B), the fuel pressure PRest at the injection start (point B) is not estimated because the fuel pressure does not increase during the period from the injection setting (point A) to the injection start (point B). In this case, it is determined whether to perform or to prohibit the injection based on whether the sensed fuel pressure Pr at the injection setting (point A) is equal to or higher than the injection permission fuel pressure TPR. The fuel pressure control valve 22 is closed for the energization time TPon of the high-pressure pump 14.

The ECU 30 carries out control at the startup such that the injection is performed during a compression stroke and ignition timing is delayed. Through the compression stroke injection at the startup, the injected fuel is collected in the vicinity of an ignition plug, thereby reducing in-cylinder wet. Through delaying the ignition timing, combustion timing is delayed and exhaust temperature is increased, thus exerting an effect of combusting unburned hydrocarbon discharged into an exhaust pipe at the startup. As a result, emissions at the startup can be reduced.

The ECU 30 performs the pressure rising startup control described above in accordance with routines shown in FIGS. 8 to 11.

Figure 8:
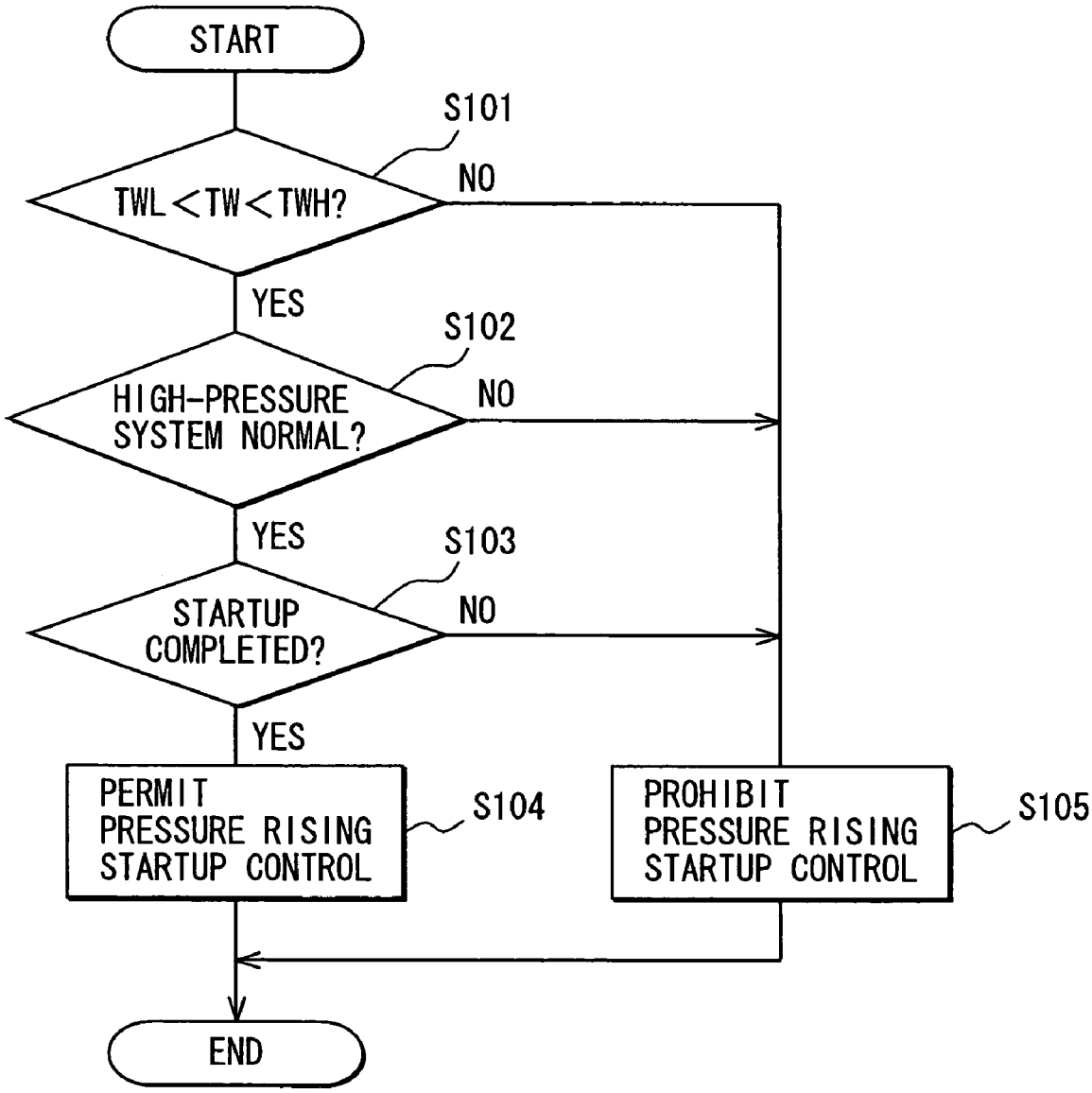
FIG. 8 is a flow chart showing a pressure rising startup control execution condition determination routine according to the FIG. 1 embodiment.

The ECU 30 activates a pressure rising startup control execution condition determination routine shown in FIG. 8 in a predetermined cycle (for example, 8 ms cycle) during the ON period of the IG switch 31 for determining an execution condition of pressure rising startup control in the following manner. First, Step S101 determines whether engine coolant temperature (engine cooling water temperature) TW is within a predetermined temperature range (TWL<TW<TWH). The lower limit TWL of the predetermined temperature range is water temperature, below which sufficient atomization time cannot be ensured during a compression stroke even if the pressure rising startup control is performed due to an increase in fuel injection quantity caused by fuel quantity increasing correction at low temperature. The lower limit TWL is set at 0° C., for example. The upper limit TWH of the predetermined temperature range is water temperature, above which it can be estimated that the fuel pressure in the high-pressure fuel pipe 26 is still maintained at a high fuel pressure because of a short lapse of time since an engine stoppage. The upper limit TWH is set at higher temperature (for example, 40° C.) than ambient temperature by a certain degree.

If the engine coolant temperature TW is out of the predetermined temperature range, the execution condition for the pressure rising startup control is determined to be unsatisfied and the process goes to Step S105, where the pressure rising startup control is prohibited.

If the engine coolant temperature TW is within the predetermined temperature range (TWL<TW<TWH), the process goes to Step S102, where it is determined whether a high-pressure system is normal by means of a self-diagnosis function incorporated in the ECU 30. The high-pressure system includes the high-pressure pump 14, a drive control system of the high-pressure pump 14, the high-pressure fuel pipe 26 and the like. If the high-pressure system is not normal, the execution condition for the pressure rising startup control is determined to be unsatisfied and the process goes to Step S105, where the pressure rising startup control is prohibited.

If the high-pressure system is normal, the process goes to Step S103, where it is determined whether a startup is completed. If it is determined that the startup is completed, the execution of the pressure rising startup control is unnecessary. Therefore, the execution condition for the pressure rising startup control is determined to be unsatisfied and the process goes to Step S105, where the pressure rising startup control is prohibited. In this case, normal injection control is performed.

If it is determined that the engine startup is not completed at Step S103, the execution condition for the pressure rising startup control is determined to be satisfied and the process goes to Step S104, where the pressure rising startup control is permitted.

The execution condition for the pressure rising startup control is satisfied if all of the following three conditions are satisfied: (1) TWL<TW<TWH (Step S101); (2) The high-pressure system is normal (Step S102); and (3) The startup is not completed (Step S103).

If any one of these conditions is not satisfied, the execution condition for the pressure rising startup control is determined to be unsatisfied and the pressure rising startup control is prohibited.

Figure 9:
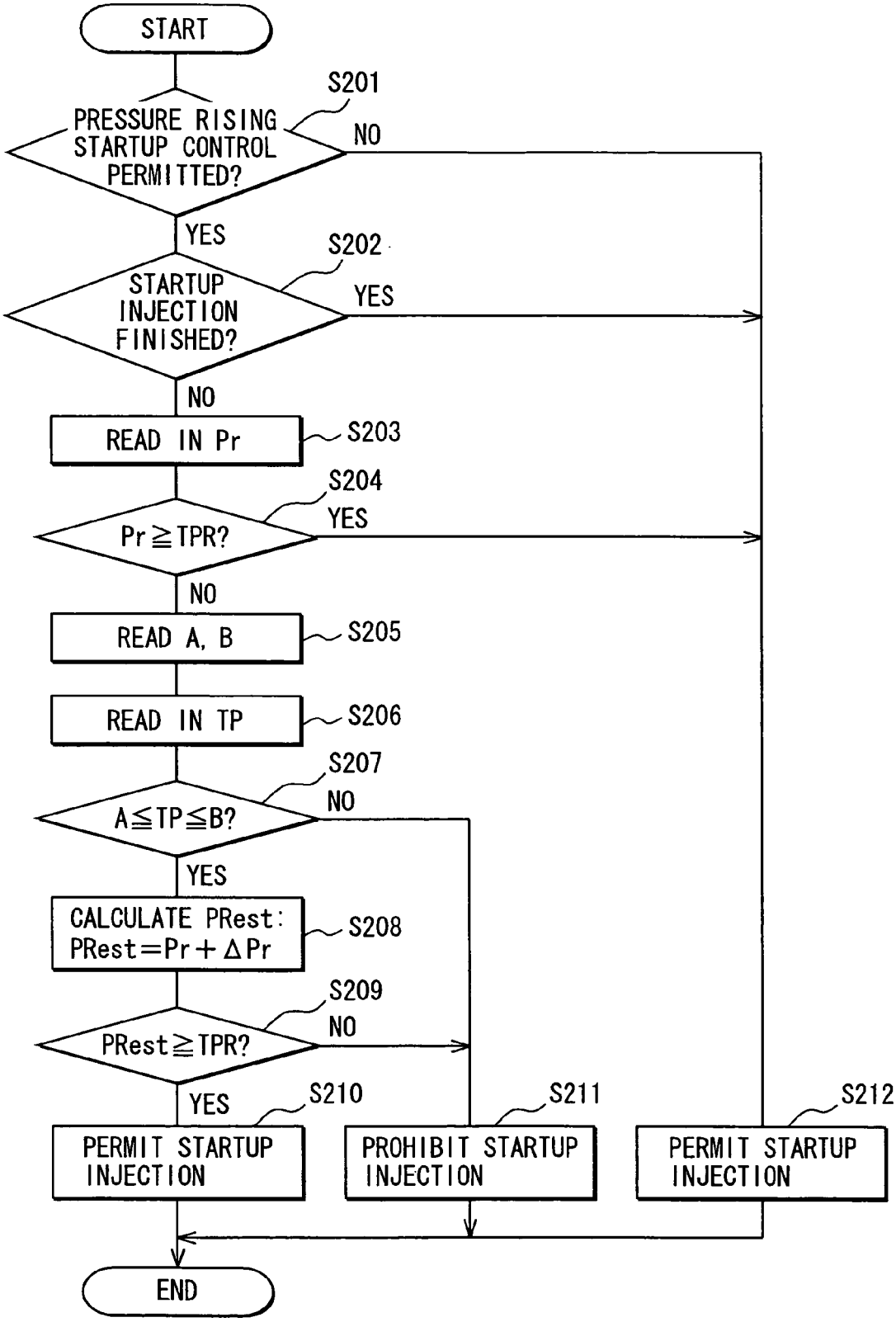
FIG. 9 is a flow chart showing a startup injection control determination routine according to the FIG. 1 embodiment.

The ECU 30 activates an engine startup injection control determination routine shown in FIG. 9 at every injection setting. When this routine is activated, first, Step S201 determines whether the pressure rising startup control is permitted based on a processing result of the above-mentioned pressure rising startup control execution condition determination routine shown in FIG. 8. If the pressure rising startup control is prohibited, the process goes to Step S212, where a startup injection is permitted. In this case, the injection is performed even if the fuel pressure is low.

If the pressure rising startup control is permitted, the process goes to Step S202, where it is determined whether the startup injection (initial injection) is finished. If the startup injection is finished, the process goes to Step S212, where the startup injection is permitted and the injection is continued. The injection is continued to complete the startup early even if the injection causes the fuel pressure to temporarily drop below the injection permission fuel pressure TPR, once the startup injection is started. If the injection is stopped after starting the injection, startup performance is deteriorated.

If the startup injection is not finished, the process goes to Step S203, where the fuel pressure Pr sensed by the fuel pressure sensor 29 at the injection setting is read. Then, the process goes to Step S204, where it is determined whether the sensed fuel pressure Pr at the injection setting is equal to or higher than the injection permission fuel pressure TPR. If the sensed fuel pressure Pr at the injection setting is already equal to or higher than the injection permission fuel pressure TPR, it is obvious that a fuel pressure at a subsequent injection start is equal to or higher than the injection permission fuel pressure TPR. Therefore, the process goes to Step S212, where the startup injection is permitted. As a result, the initial injection is performed.

If the sensed fuel pressure Pr at the injection setting is lower than the injection permission fuel pressure TPR, the fuel pressure PRest at the injection start is estimated in the following manner. First, Step S205 stores a current crank angle A (injection setting time) and a crank angle B (injection start time) at an injection start in a memory such as a RAM in the ECU 30. Thereafter, the process goes to Step S206, where a crank angle TP (energization end time) at an end of the energization of the high-pressure pump 14 is read. Then, as shown in FIG. 7, Step S207 determines whether the crank angle TP exists in a range from the current crank angle A and the crank angle B at the injection start (whether $A \leqq TP \leqq B$ is satisfied). Thus, it is determined whether there is a fuel discharge (point TP) from the high-pressure pump 14 during the period from the injection setting (point A) to the injection start (point B).

If it is determined that there is no fuel discharge from the high-pressure pump 14 during the period from the injection setting (point A) to the injection start (point B), the fuel pressure PRest at the injection start is not estimated because the fuel pressure Pr does not increase during the period from the injection setting (point A) to the injection start (point B). In this case, since the sensed fuel pressure Pr at the injection setting is determined to be lower than the injection permission fuel pressure TPR at Step S204, the fuel pressure PRest at the injection start is also determined to be lower than the injection permission fuel pressure TPR. The process goes to Step S211, where the startup injection is prohibited.

If, Step S207 determines that there is a fuel discharge (point TP) from the high-pressure pump 14 during the period from the injection setting (point A) to the injection start (point B), the process goes to Step S208. Step S208 adds an estimate of the fuel pressure increment $\Delta Pr$ from the injection setting to the injection start to the sensed fuel pressure Pr at the current time (at the injection setting). Thus, an estimated fuel pressure PRest at the injection start is obtained ($PRest = Pr + \Delta Pr$).

The fuel pressure increment $\Delta Pr$ is calculated by a fuel pressure increment calculation routine shown in FIG. 10 (explained later).

As described above, the fuel pressure increment $\Delta Pr$ may be a preset fixed value or may be calculated by means of a map or formula based on the fuel temperature and/or fuel pressure Pr at the injection setting. Alternatively, a learned value of the fuel pressure increment $\Delta Pr$ learned at every startup may be used.

Thereafter, the process goes to Step S209, where it is determined whether the estimated fuel pressure PRest at the injection start is equal to or higher than the injection permission fuel pressure TPR. If the estimated fuel pressure PRest at the injection start is equal to or higher than the injection permission fuel pressure TPR, the process goes to Step S210, where the startup injection is permitted. As a result, the initial injection is performed. If the estimated fuel pressure PRest at the injection start is determined to be lower than the injection permission fuel pressure TPR, the process goes to Step S211, where the startup injection is prohibited.

Through the above-mentioned processing, the injection is stopped and fuel pressure rising through the fuel discharge performed by the high-pressure fuel pump 14 is prioritized during the period since the cranking is started until the estimated fuel pressure PRest at the injection start (or the sensed fuel pressure Pr at the injection setting) becomes equal to or higher than the injection permission fuel pressure TPR. Thus, the fuel pressure increases to the injection permission fuel pressure TPR or higher in an early stage.

Figure 10:
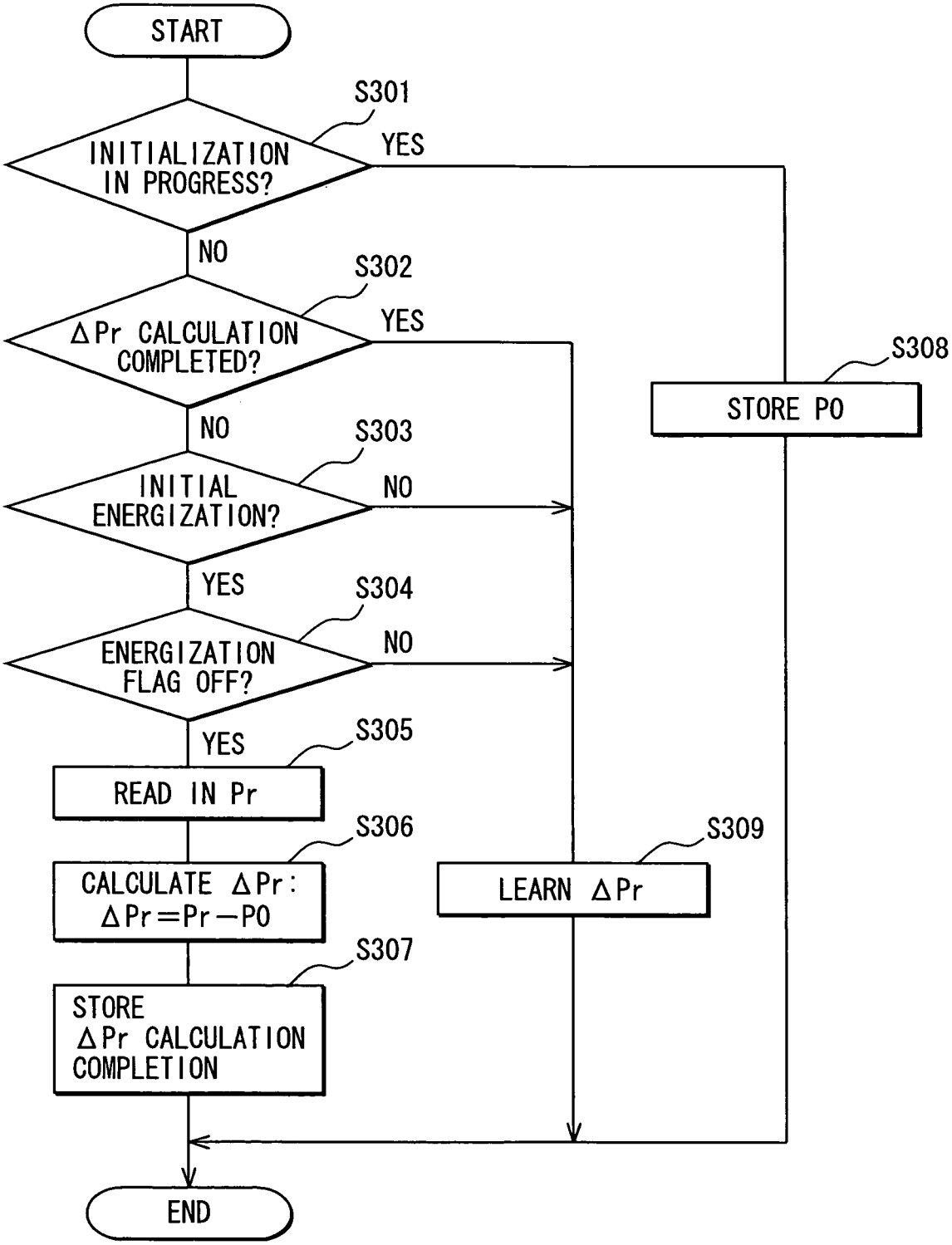
FIG. 10 is a flow chart showing a fuel pressure increment calculation routine according to the FIG. 1 embodiment.

The ECU 30 executes a fuel pressure increment calculation routine shown in FIG. 10 at every injection setting before executing the above-mentioned startup injection control determination routine shown in FIG. 9. If this routine is activated, first, Step S301 determines whether initialization immediately after turning-on of the IG switch 31 is in progress. If the initialization is in progress, the process goes to Step S308, where a fuel pressure sensed by the fuel pressure sensor 29 before the initial discharge stroke of the high-pressure pump 14 is stored as a base fuel pressure P0 in a memory such as a RAM in the ECU 30. Then, this routine is terminated.

If the initialization is finished, the process goes to Step S302, where it is determined whether the calculation of the fuel pressure increment ΔPr is completed. If the calculation of the fuel pressure increment ΔPr is completed, the process goes to Step S309. Step S309 renews and stores the fuel pressure increment ΔPr calculated theretofore as a learned value in a rewritable nonvolatile memory such as a backup RAM in the ECU 30. Then, this routine is terminated.

If Step S302 determines that the calculation of the fuel pressure increment ΔPr is not completed, the process goes to Step S303. Step S303 determines whether energization of the high-pressure pump 14 is the initial one (whether the discharge is the first one). If the energization of the high-pressure pump 14 is the second or subsequent energization (second or subsequent discharge), the process goes to Step S309, where the fuel pressure increment ΔPr estimated theretofore is learned. Thus, this routine is terminated.

If Step S303 determines that the energization of the high-pressure pump 14 is the first one (first discharge), the process goes to Step S304, where it is determined whether an energization flag is reset to OFF (whether the first discharge is finished). If the energization flag is determined to be ON (fuel discharge is under way), the process goes to Step S309, where the fuel pressure increment ΔPr estimated theretofore is learned and this routine terminates.

Thereafter, when the energization flag is reset to OFF (when the first discharge is finished), "YES" determination is made at Step S304, and the process goes to Step S305. Step S305 reads in the fuel pressure Pr sensed by the fuel pressure sensor 29 at the current time (when the first discharge is finished). Then, the process goes to Step S306, where a fuel pressure difference (Pr−P0) between the sensed fuel pressure Pr at the current time (when the first discharge is finished) and the base fuel pressure P0 is calculated to obtain the fuel pressure increment ΔPr from the injection setting to the injection start (ΔPr=Pr−P0).

During the first discharge stroke, the fuel pressure in the high-pressure fuel pipe 26 including the delivery pipe 27 is low, and a change in the fuel temperature in the high-pressure fuel pipe 26 (replacement with low-temperature fuel in the fuel tank 11) is small. Accordingly, a variation in the fuel pressure increment ΔPr due to the first discharge is small. Therefore, the fuel pressure increment ΔPr is calculated from the fuel pressure difference (Pr−P0) across the first discharge stroke in this example embodiment. However, the present invention does not exclude calculating a fuel pressure difference ΔPr across a second or subsequent discharge stroke of the high-pressure pump 14.

Thereafter, the process goes to Step S307, where information about the completion of the calculation of the fuel pressure increment ΔPr is stored. Then, this routine terminates.

Figure 11:
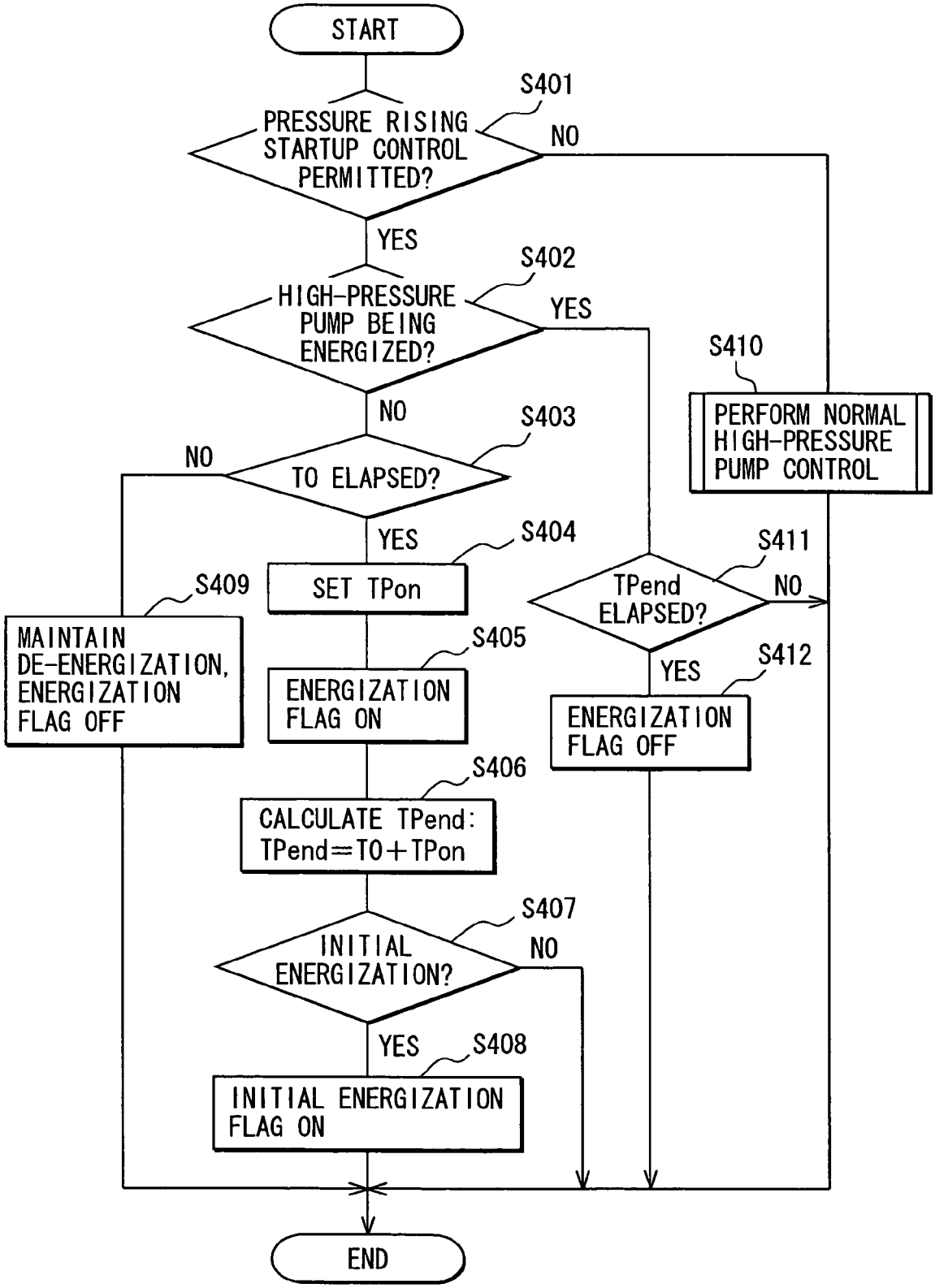
FIG. 11 is a flow chart showing a startup high-pressure pump control routine according to the FIG. 1 embodiment.

The ECU 30 executes a startup high-pressure pump control routine shown in FIG. 11 in a predetermined cycle (for example, 8 ms cycle) during the ON period of the IG switch 31. When this routine is activated, first, Step S401 determines whether the pressure rising startup control is permitted based on the processing result of the pressure rising startup control execution condition determination routine shown in FIG. 8. If the pressure rising startup control is prohibited, the process goes to Step S410, where a normal high-pressure pump control routine (not shown) is executed for performing normal control of the high-pressure pump 14.

If Step S401 determines that the pressure rising startup control is permitted, the process goes to Step S402, where it is determined whether the high-pressure pump 14 is being energized (in the process of discharge). If the high-pressure pump 14 is not being energized (not in the process of discharge), the process goes to Step S403. Step S403 determines whether an energization start time T0 (time or crank angle from the injection setting to the energization start) has elapsed. If the energization start time TO has not elapsed, the process goes to Step S409, where the energization flag is kept at OFF to maintain the high-pressure pump 14 in a de-energized state (state in which the fuel is not discharged).

Thereafter, at the time when the energization start time T0 elapses, the process goes to Step S404. Step S404 sets a predetermined energization time TPon for determining a discharge time (valve closing time of the fuel pressure control valve 22) of the pressure rising startup control. Then, the process goes to Step S405, where the energization flag is set at ON. Thereafter, the process goes to Step S406, where the energization time TPon is added to the energization start time T0 to obtain an energization end time TPend (time or crank angle from the injection setting to an end of the energization) (TPend=T0+TPon).

Then, the process goes to Step S407, where it is determined whether the energization of the high-pressure pump 14 is the initial energization (whether the discharge is the first one). If the energization of the high-pressure pump 14 is the initial energization (first discharge), the process goes to Step S408. Step S408 sets an initial energization flag at ON to permit the initial energization. If step S407 determines that the energization is second or subsequent energization (second or subsequent discharge), this routine terminates.

If Step S402 determines that the high-pressure pump 14 is being energized (in the process of discharge), the process goes to Step S411. Step S411 determines whether the energization end time TPend has elapsed. If it is determined that the energization end time TPend has not elapsed yet, the energization of the high-pressure pump 14 is continued. If the energization end time TPend elapses, the process goes to Step S412, where the energization flag is set at OFF to terminate the energization of the high-pressure pump 14 and open the fuel pressure control valve 22 to terminate the discharge from the high-pressure pump 14.

According to the first example embodiment described above, at the time of injection setting, the fuel pressure increment ΔPr from the injection setting to the injection start is estimated based on the fuel pressure difference (Pr−P0) across the discharge stroke of the high-pressure pump 14 sensed by the fuel pressure sensor 29 before the injection setting. Further, the fuel pressure increment ΔPr is added to the sensed fuel pressure Pr at the injection setting to estimate a fuel pressure PRest at the injection start. It is determined whether to permit or to prohibit the injection based on whether the estimated fuel pressure PRest at the injection start is equal to or higher than the injection permission fuel pressure TPR suitable for the startup. Therefore, control can be executed to perform the injection if it is estimated that the fuel pressure PRest at the injection start, which is estimated at the injection setting, will have increased to the injection permission fuel pressure TPR, even if an actual fuel pressure Pr at the injection setting has not reached yet the injection permission fuel pressure TPR in the process of cranking the engine with the starter. Therefore, startup time can be shortened without taking the measures of increasing the size of the high-pressure pump 14 or decreasing the volume of the high-pressure fuel pipe 26 or delivery pipe 27. As a result, the requirements such as improved engine startup properties and reduced emissions at the startup can be met.

Moreover, in the first example embodiment, if there is a fuel discharge from the high-pressure pump 14 during the period from the injection setting to the injection start, the fuel pressure PRest at the injection start is estimated and based on the predicted fuel pressure PRest, it is determined whether the injection should be performed. If there is no fuel discharge from the high-pressure pump 14 during the period from the injection setting to the injection start, it is determined whether the injection should be performed based on the fuel pressure Pr sensed by the fuel pressure sensor 29 at the injection setting. Therefore, it is possible to determine whether the injection should be performed in an appropriate manner depending on the presence or absence of fuel discharge from the high-pressure pump 14 during the period from the injection setting to the injection start. If there is no fuel discharge from the high-pressure pump 14 during the period from the injection setting to the injection start, the estimate of the fuel pressure PRest may not be calculated. Thus, the calculation load of the ECU 30 is reduced.

As previously mentioned, as the fuel pressure Pr at the injection setting increases, the actual fuel pressure increment ΔPr tends to decrease. As the fuel temperature rises, the actual fuel pressure increment ΔPr tends to increase due to thermal expansion or the like of the fuel.

Figure 12:
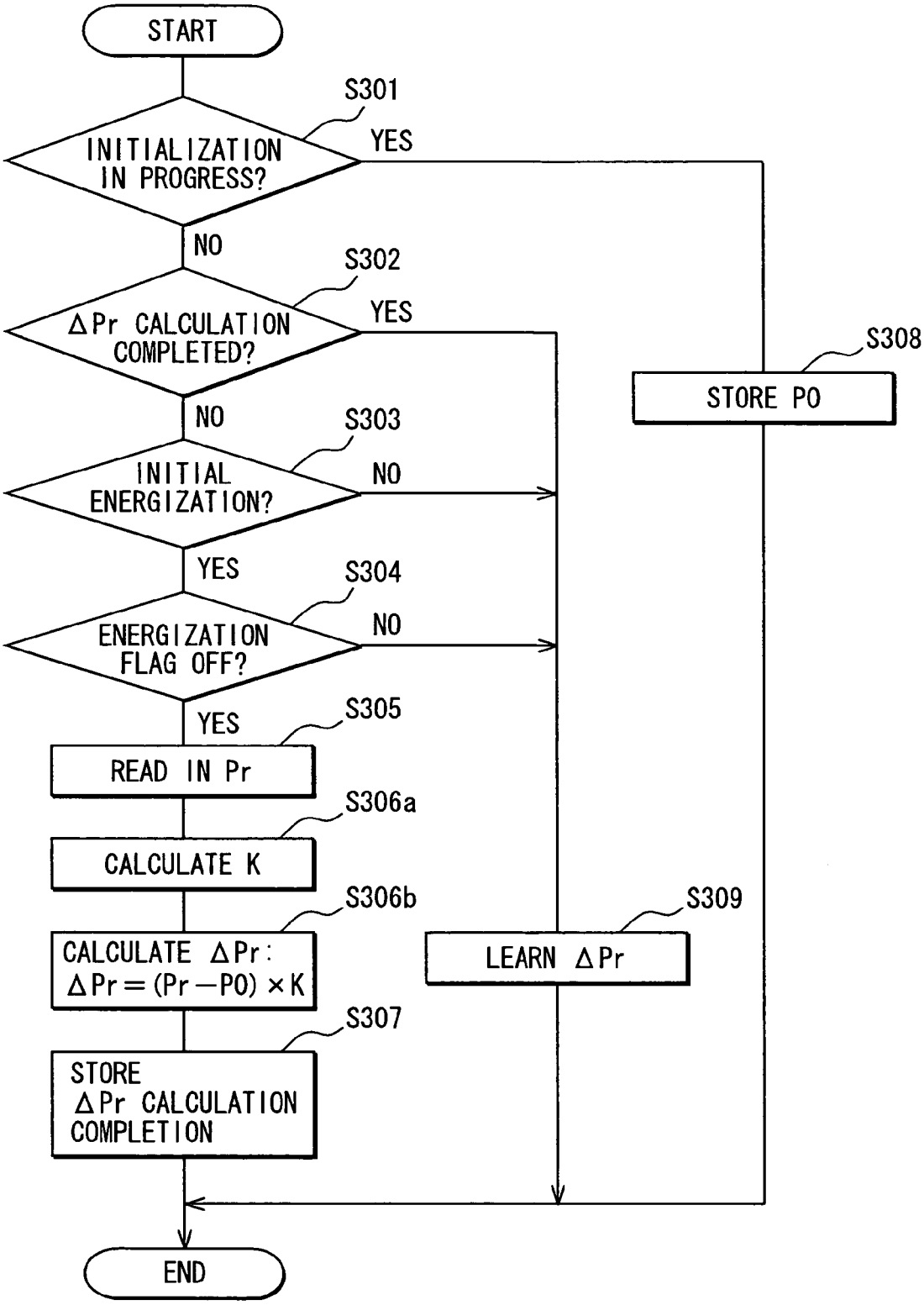
FIG. 12 is a flow chart showing a fuel pressure increment calculation routine according to a second example embodiment of the present invention.
Figure 13:
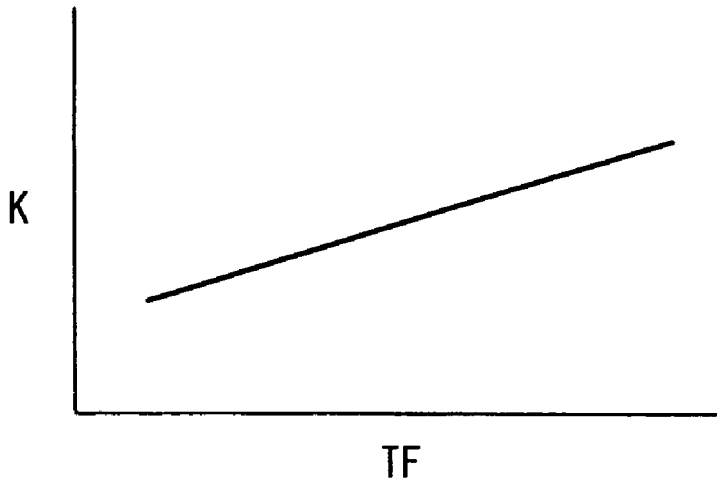
FIG. 13 is a diagram showing a map for calculating a correction factor according to the FIG. 12 embodiment.
Figure 14:
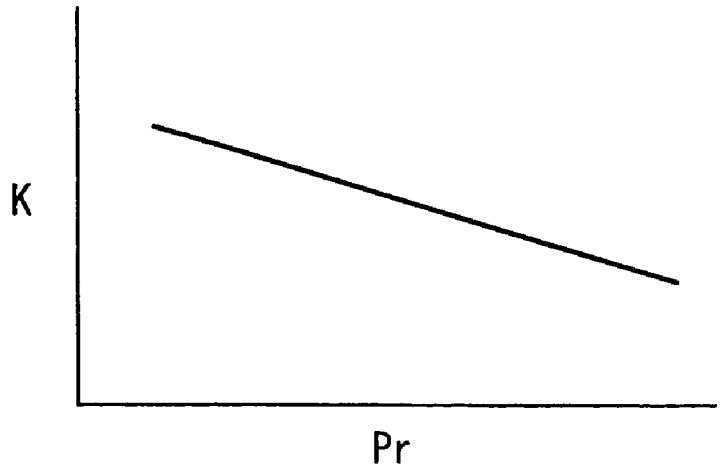
FIG. 14 is a diagram showing a map for calculating the correction factor according to the FIG. 12 embodiment.

In view of this respect, a second example embodiment of the present invention shown in FIGS. 12 to 14 corrects a fuel pressure difference (Pr−P0) across a discharge stroke of the high-pressure pump 14 by a correction factor K corresponding to the sensed fuel pressure Pr and/or fuel temperature TF at the injection setting to estimate the fuel pressure increment ΔPr from the injection setting to the injection start.

A fuel pressure increment calculation routine shown in FIG. 12 according to the second embodiment is a modification of the above-mentioned fuel pressure increment calculation routine of FIG. 10. The process at Step S306 is replaced with two steps of Steps S306*a* and S306*b*, but the other processes are the same as those in the fuel pressure increment calculation routine of FIG. 10.

In the fuel pressure increment calculation routine shown in FIG. 12, the process goes to Step S305 after completion of an initial energization (first discharge) of the high-pressure pump 14. Step S305 reads in a fuel pressure Pr sensed by the fuel pressure sensor 29 at the current time (when the first discharge is finished). Then, the process goes to Step S306*a*, where a correction factor K is calculated. Step S306*a* may calculate the correction factor K in accordance with the fuel temperature TF at the injection setting by using a map or formula that uses as a parameter the fuel temperature TF at the injection setting as shown in FIG. 13. Alternatively, a map or formula for calculating the correction factor K that uses as a parameter the fuel pressure Pr at the injection setting as shown in FIG. 14 may be used to calculate the correction factor K in accordance with the sensed fuel pressure Pr at the injection setting. Alternatively, a two-dimensional map of the correction factor K that uses as parameters the fuel temperature TF and fuel pressure Pr at the injection setting may be used to calculate the fuel pressure increment ΔPr in accordance with the fuel temperature TF and the sensed fuel pressure Pr at the injection setting. In this case, the map shown in FIG. 13 is set so that the correction factor K increases as the fuel temperature TF at the injection setting rises. The map shown in FIG. 14 is set so that the correction factor K decreases as the fuel pressure Pr at the injection setting increases.

After the calculation of the correction factor K, the process goes to Step S306*b*, where the fuel pressure difference (Pr−P0) between the sensed fuel pressure Pr at the current time (when the first discharge is finished) and the base fuel pressure P0 is corrected by the correction factor K to obtain the fuel pressure increment ΔPr from the injection setting to the injection start (ΔPr=(Pr−P0)×K).

The process then goes to Step S307, where information about the completion of the calculation of the fuel pressure increment ΔPr is stored. Thus, this routine terminates. The other processes are the same as those in the first embodiment.

The actual fuel pressure increment ΔPr varies depending on the fuel pressure Pr and the fuel temperature TF. Therefore, in the second example embodiment, the fuel pressure difference (Pr−P0) across the discharge stroke of the high-pressure pump 14 is corrected with the correction factor K depending on the sensed fuel pressure Pr and/or fuel temperature TF at the injection setting. Thus, the fuel pressure increment ΔPr from the injection setting to the injection start is estimated. Therefore, the estimation accuracy of the fuel pressure at the injection start is improved further than the first example embodiment.

The present invention should not be limited to the disclosed embodiments, but may be implemented in many other ways without departing from the spirit of the invention.

What is claimed is:

1. A startup controller for an in-cylinder injection internal combustion engine having a high-pressure pump for pressurizing fuel to high pressure and for supplying the fuel to a fuel injection valve that injects the fuel directly into a cylinder, the startup controller comprising:

an injection setting device that makes an injection setting for setting injection start timing and an injection duration prior to a start of injection;

an injection controlling device that drives the fuel injection valve to perform the injection at the injection start timing for the injection duration set by the injection setting device;

a fuel pressure sensing device that senses a pressure of the fuel to be supplied to the fuel injection valve; and a startup controlling device that, when the injection setting is made at a startup of the engine, estimates a fuel pressure at a subsequent injection start based on the fuel pressure sensed by the fuel pressure sensing device and determines whether the injection by the injection controlling device should be performed or prohibited based on the estimated fuel pressure.

2. The startup controller as in claim 1, wherein;

the startup controlling device, if there is a fuel discharge from the high-pressure pump during a period from the injection setting to the injection start, estimates the fuel pressure at the injection start and determines whether to perform the injection based on the estimated fuel pressure, and the startup controlling device, if there is no fuel discharge from the high-pressure pump during the period from the injection setting to the injection start, determines whether to perform the injection based on the fuel pressure sensed by the fuel pressure sensing device at the injection setting.

3. The startup controller as in claim 1, wherein;

the startup controlling device estimates a fuel pressure increment from the injection setting to the injection start based on a fuel pressure difference across a discharge stroke of the high-pressure pump sensed by the fuel pressure sensing device prior to the injection setting, and the startup controlling device estimates the fuel pressure at the injection start by adding the fuel pressure increment to the fuel pressure sensed at the injection setting.

4. The startup controller as in claim 3, wherein;

the startup controlling device estimates the fuel pressure increment by correcting the fuel pressure difference across the discharge stroke of the high-pressure pump with at least one of the sensed fuel pressure and fuel temperature at the injection setting.

5. The startup controller as in claim 3, wherein;

the startup controlling device estimates the fuel pressure increment from the injection setting to the injection start based on a fuel pressure difference across an initial discharge stroke of the high-pressure pump after a start of cranking of the engine.

6. The startup controller as in claim 1, wherein;

the startup controlling device estimates a fuel pressure increment from the injection setting to the injection start based on at least one of the sensed fuel pressure and fuel temperature at the injection setting, and the startup controlling device estimates the fuel pressure at the injection start by adding the fuel pressure increment to the fuel pressure sensed at the injection setting.

7. The startup controller as in claim 1, wherein;

the startup controlling device performs the injection during a compression stroke of the engine and delays ignition timing at the startup of the engine.

8. A startup controlling method of an in-cylinder injection internal combustion engine having a high-pressure pump for pressurizing fuel to high pressure and for supplying the fuel to a fuel injection valve that injects the fuel directly into a cylinder, the startup controlling method comprising:

making an injection setting for setting injection start timing and an injection duration prior to a start of injection;

driving the fuel injection valve to perform the injection at the set injection start timing for the set injection duration;

sensing a pressure of the fuel to be supplied to the fuel injection valve;

estimating a fuel pressure at a subsequent injection start based on the sensed fuel pressure when the injection setting is made at a startup of the engine; and determining whether to perform or to prohibit the injection based on the estimated fuel pressure when the injection setting is made at the startup of the engine.

9. The startup controlling method as in claim 8, further comprising:

estimating the fuel pressure at the injection start if there is a fuel discharge from the high-pressure pump during a period from the injection setting to the injection start;

determining whether to perform the injection based on the estimated fuel pressure if there is the fuel discharge from the high-pressure pump during the period from the injection setting to the injection start; and determining whether to perform the injection based on the fuel pressure sensed at the injection setting if there is no fuel discharge from the high-pressure pump during the period from the injection setting to the injection start.

10. The startup controlling method as in claim 8, further comprising:

estimating a fuel pressure increment from the injection setting to the injection start based on a fuel pressure difference across a discharge stroke of the high-pressure pump sensed prior to the injection setting; and estimating the fuel pressure at the injection start by adding the fuel pressure increment to the fuel pressure sensed at the injection setting.

11. The startup controlling method as in claim 10, further comprising:

estimating the fuel pressure increment by correcting the fuel pressure difference across the discharge stroke of the high-pressure pump with at least one of the sensed fuel pressure and fuel temperature at the injection setting.

12. The startup controlling method as in claim 10, further comprising:

estimating the fuel pressure increment from the injection setting to the injection start based on a fuel pressure difference across an initial discharge stroke of the high-pressure pump after a start of cranking of the engine.

13. The startup controlling method as in claim 8, further comprising:

estimating a fuel pressure increment from the injection setting to the injection start based on at least one of the sensed fuel pressure and fuel temperature at the injection setting; and estimating the fuel pressure at the injection start by adding the fuel pressure increment to the fuel pressure sensed at the injection setting.

14. The startup controlling method as in claim 8, further comprising:

performing the injection during a compression stroke of the engine at the startup of the engine; and delaying ignition timing at the startup of the engine.

* * * * *